United States Patent [19]

Takashima et al.

[11] Patent Number: 4,792,542

[45] Date of Patent: Dec. 20, 1988

[54] RECORDING MATERIAL

[75] Inventors: Masanobu Takashima; Masato Satomura; Ken Iwakura; Akira Igarashi, all of Shizuoka, Japan

[73] Assignee: Fuji Photo Film Co., Ltd., Kanagawa, Japan

[21] Appl. No.: 928,354

[22] Filed: Nov. 10, 1986

[30] Foreign Application Priority Data

| | | | |
|---|---|---|---|
| Nov. 8, 1985 | [JP] | Japan | 60-250282 |
| Nov. 8, 1985 | [JP] | Japan | 60-250283 |
| Dec. 5, 1985 | [JP] | Japan | 60-274157 |
| Jan. 20, 1986 | [JP] | Japan | 61-9731 |
| Jan. 20, 1986 | [JP] | Japan | 61-9732 |
| Mar. 27, 1986 | [JP] | Japan | 61-69583 |

[51] Int. Cl.[4] ..... B41M 5/18

[52] U.S. Cl. ..... 503/208; 427/150; 427/151; 428/913; 503/209; 503/225; 503/226

[58] Field of Search ..... 346/208, 209; 427/150–152; 428/913, 914; 503/208, 209, 225, 226

[56] References Cited

U.S. PATENT DOCUMENTS

| | | | |
|---|---|---|---|
| 4,502,068 | 2/1985 | Taniguchi et al. | 427/150 |
| 4,506,278 | 3/1985 | Sakamoto et al. | 503/216 |
| 4,511,910 | 4/1985 | Taniguchi et al. | 346/216 |
| 4,547,788 | 10/1985 | Kurisu et al. | 346/208 |
| 4,562,448 | 12/1985 | Watanabe et al. | 346/208 |
| 4,571,605 | 2/1986 | Motosugi et al. | 346/216 |
| 4,628,335 | 12/1986 | Igarashi et al. | 346/209 |

FOREIGN PATENT DOCUMENTS

| | | | |
|---|---|---|---|
| 3414297 | 10/1984 | European Pat. Off. . | |
| 0141170 | 5/1985 | European Pat. Off. . | |
| 3444396 | 6/1985 | Fed. Rep. of Germany . | |
| 0222457 | 10/1985 | Japan | 503/216 |

*Primary Examiner*—Bruce H. Hess

*Attorney, Agent, or Firm*—Sughrue, Mion, Zinn, Macpeak, and Seas

[57] ABSTRACT

A recording material is described comprising an electron donating colorless dye, an electron accepting compound, and at least one compound represented by formula (I), (II), or (III)

$$Ar_1O—R—SAr_2 \quad (I)$$

$$Ar_1S—R—SAr_2 \quad (II)$$

$$Ar_1S—R—X—Ar_2 \quad (III)$$

wherein $Ar_1$ and $Ar_2$ each represents a substituted or unsubstituted aryl group or a substituted or unsubstituted heterocyclic ring, R is a divalent group containing from 1 to 10 carbon atoms, and X represents —COO— group or $$-O-\overset{\overset{\displaystyle O}{\|}}{C}-$$

group.

15 Claims, No Drawings

RECORDING MATERIAL

FIELD OF THE INVENTION

The present invention relates to a recording material, and more particularly, to a heat-sensitive recording material having improved keeping stability with elapse of time and color formability.

BACKGROUND OF THE INVENTION

Heat-sensitive recording materials which utilize an electron donating colorless dye and an electron accepting compound are well known, and are disclosed, e.g., in British Pat. No. 2,140,449.

Properties which heat-sensitive recording materials must be possessed of at the minimum are (1) to have satisfactorily high color density of the developed image, (2) to undergo no color development upon storage prior to use, (3) to yield a colored product which retains sufficient fastness after color development, and so on. However, recording materials which simultaneously satisfy all of these requisites to perfection have not yet been obtained.

In particular, studies on the property (1) described above have been made energetically with the speeding-up of heat-sensitive recording systems in recent years.

One of measures which have been attempted with the intention of conferring the property (1) on heat-sensitive recording materials involves the use of an electron accepting compound having a melting point lower than 120° C. In another measure, a combination of an organic acid and a phenolic compound is used as an electron accepting substance. In addition, the use of a polyvalent metal salt of a compound having an alcoholic hydroxyl group, the use of a copolymer prepared from hydroxyethyl cellulose and maleic anhydride, the addition of waxes, the addition of thioacetoanilide, phthalonitrile, acetamide, di-β-naphthyl-p-phenylenediamine, a fatty acid amide, acetoacetic acid anilide, diphenylamine, benzamide, a nitrogen-containing organic compound like carbazole, a thermofusible substance such as 2,3-di-m-tolybutane, 4,4'-dimethylbiphenyl, etc., or a carboxylic acid ester such as dimethyl isophthalate, diphenyl phthalate, dimethyl terephthalate, etc. as a sensitizer, and the addition of hindered phenols have been examined for efficiency in heightening the color density of developed image.

However, heat-sensitive recording materials produced utilizing such measures are insufficient in color density of the developed image and coloring speed.

On the other hand, developments of various aromatic ethers are proceeded, and it has been found that phenyl phenoxyacetate, diphenoxyethane, and the like are particularly excellent in sensitizing effect (e.g., Japanese patent application (OPI) Nos. 58,789/86, 123,581/86, and 176,544/86, etc.). (The term "OPI" as used herein refers to a "published unexamined Japanese patent application.") However, it has also been found that these ethers are attended by some problems.

For instance, sensitizers having an ester moiety derived from phenol, such as phenyl phenoxyacetate, suffer from a difficult point in their own keeping stability with elapse of time.

Also, diether compounds having good symmetry, such as diphenoxyethane, have a defect that when coated on a sheet of paper it is difficult to obtain sufficient keeping stability with elapse of time.

SUMMARY OF THE INVENTION

Therefore, objects of the present invention are to provide a heat-sensitive recording material having satisfactorily high color density of developed image, sufficiently high coloring speed, and excellent keeping stability with elapse of time.

The objects of the present invention are attained with a heat-sensitive recording material comprising an electron donating colorless dye, an electron accepting compound, and at least one compound represented by formula (I), (II), or (III)

$$Ar_1O—R—SAr_2 \quad (I)$$

$$Ar_1S—R—SAr_2 \quad (II)$$

$$Ar_1S—R—X—Ar_2 \quad (III)$$

wherein $Ar_1$ and $Ar_2$ each represents a substituted or unsubstituted aryl group, or a substituted or unsubstituted heterocyclic ring, R represents a divalent group containing from 1 to 10 carbon atoms, and X represents —COO— group or $$-O-\overset{\overset{\displaystyle O}{\|}}{C}-$$

group.

DETAILED DESCRIPTION OF THE INVENTION $Ar_1$ and $Ar_2$ each preferably represents a substituted or unsubstituted phenyl group, naphthyl group, or anthryl group which may be fused together with another ring, or a substituted or unsubstituted 5- or 6-membered heterocyclic ring containing at least one hetero atom such as an oxygen atom, a nitrogen atom, a sulfur atom, etc. The heterocyclic ring may be a monocyclic ring or a fused ring with another ring.

A phenyl group and a naphthyl group are of the greatest advantage as an aryl group from the standpoint of the facilities for obtaining and handling starting materials.

The group or the ring represented by $Ar_1$ or $Ar_2$ can have at least one substituent, such as a cyano group, an alkylthio group, an acyl group, an alkyl group, an aryloxy group, an alkoxy group, an acylamino group, a halogen atom, an alkyoxycarbonyl group, an aralkyl group, an aralkyloxycarbonyl group, an alkenyl group, an alkenyloxy group, an alkynyl group, a cycloalkenyl group, an oxy group, an alkanesulfonyl group, a carbonato group, a sulfo group, a sulfonato group, an aryl group, etc.

Of these substituents, generally groups containing not more than 15 carbon atoms, and preferably those containing not more than 4 carbon atoms, can impart excellent properties to the foregoing compounds.

Specifically, such groups include a methyl group, ethyl group, isopropyl group, methoxy group, ethoxy group, allyl group, chlorine atom, fluorine atom, acetyl group, propionyl group, butoxy group, oxy group, methylthio group, methoxycarbonyl group, chloromethyl group, and so on.

A divalent group represented by R preferably contains from 1 to 10 carbon atoms. In formulae (I) and (III), it is more preferable for R to contain from 1 to 8 carbon atoms. Particularly preferred examples of such divalent groups include straight or branched chain alkylene, oxyalkylene, thioalkylene, and alkenylene group. Of these groups, straight chain alkylene, oxyalkylene, polyoxyalkylene, thioalkylene, and like groups, each of which contains not more than 6 carbon atoms, are superior to others in facility of preparation, purification of the product, and so on.

Compounds which are lipophilic, and have high degree of whiteness and a melting point ranging from 60° C. to 180° C., particularly from 85.0° C. to 125.0° C., are preferred as the compounds of the present invention. A heat-sensitive recording material containing one of the compounds of the present invention has not only sufficiently high color density and coloring speed, but also only a slight decrease in color density with the lapse of time before use, and reduced fog. In addition, the color image developed therein has sufficient fastness.

Specific examples of the compounds of the present invention are described below. However, the invention is not to be construed as being limited to these examples.

COMPOUNDS OF FORMULA (I)

(1-1) 1-(p-tolylthio)-4-phenoxybutane,
(1-2) 1-(p-tolylthio)-4-(p-chlorophenoxy)butane,
(1-3) 1-phenylthio-2-(p-tolyloxy)ethane,
(1-4) 1-(p-tolylthio)-2-(p-ethoxyphenoxy)ethane,
(1-5) 1-(p-tolylthio)-2-(naphthyl-2-oxy)ethane,
(1-6) 1-(p-tolylthio)-2-(p-biphenyloxy)ethane,
(1-7) 1-(m-tolylthio)-8-(p-biphenyloxy)octane,
(1-8) 1-(p-fluorobenzenethio)-2-(p-biphenyloxy)ethane,
(1-9) 1-(p-bromobenzenethio)-2-(p-methylbiphenyloxy)ethane,
(1-10) 1-(p-methoxybenzenethio)-2-(p-ethoxyphenoxy)ethane,
(1-11) 1-(p-methoxybenzenethio)-6-(p-ethoxyphenoxy)hexane,
(1-12) 1-(p-methoxybenzenethio)-2-(p-biphenyloxy)ethane,
(1-13) 1-(p-methoxybenzenethio)-2-(m-chlorophenoxy)ethane,
(1-14) 1-(p-ethoxybenzenethio)-2-(p-methoxyphenoxy)ethane,
(1-15) 1-(p-allyloxybenzenethio)-2-(p-methoxyphenoxy)ethane,
(1-16) 1-(p-benzyloxybenzenethio)-2-(p-methoxyphenoxy)ethane,
(1-17) 1-(p-n-propoxybenzenethio)-2-(p-methoxyphenoxy)ethane,
(1-18) 1-(p-iso-propoxybenzenethio)-2-(p-methoxyphenoxy)ethane,
(1-19) 1-(p-propargyloxybenzenethio)-2-(p-methoxyphenoxy)ethane,
(1-20) 1-(o-chlorobenzyloxybenzenethio)-2-(p-methoxyphenoxy)ethane,
(1-21) 1-(o-methylbenzyloxybenzenethio)-2-(p-methoxyphenoxy)ethane,
(1-22) 1-(3-chloropropoxybenzenethio)-2-(p-methoxyphenoxy)ethane,
and so on.

COMPOUNDS OF FORMULA (II)

(2-1) 1,2-bis(phenylthio)ethane,
(2-2) 1,2-bis(4-methoxyphenylthio)ethane,
(2-3) 1,2-bis(3-methoxyphenylthio)ethane,
(2-4) 1,2-bis(4-methylphenylthio)ethane,
(2-5) 1,2-bis(2-methylphenylthio)ethane,
(2-6) 1,2-bis(4-methylphenylthio)propane,
(2-7) 1-(4-methylphenylthio)-2-(4-methoxyphenylthio)ethane,
(2-8) 1,4-bis(4-methoxyphenylthio)butane,
(2-9) 1,6-bis(4-methylphenylthio)hexane,
(2-10) bis[2-(4-methoxyphenylthio)ethyl]sulfide,
(2-11) bis[2-(4-methylphenylthio)ethyl]ether,
(2-12) 1,7-bis(4-methoxyphenylthio)-3,5-dioxaheptane,
(2-13) 1,2-bis(2-naphthylthio)ethane,
and so on.

COMPOUNDS OF FORMULA (III)

(3-1) phenylthioacetic p-biphenyl ester,
(3-2) phenylthioacetic p-ethoxyphenyl ester,
(3-3) phenylthioacetic 2-naphthyl ester,
(3-4) phenylthioacetic p-chlorophenyl ester,
(3-5) p-tolylthioacetic p-biphenyl ester,
(3-6) p-tolylthioacetic p-chlorophenyl ester,
(3-7) m-tolylthioacetic p-biphenyl ester,
(3-8) p-chlorobenzenethiovaleric phenyl ester,
(3-9) phenylthioacetic p-cyclohexylphenyl ester,
(3-10) 1-benzoyloxy-2-phenylthioethane,
(3-11) 1-(p-methylbenzoyloxy)-2-phenylthioethane,
(3-12) 1-(p-methoxybenzoyloxy)-2-phenylthioethane,
and so on.

(I) Compounds represented by formula (I) can be easily prepared as follows: A phenoxyalkyl alcohol is converted to its tosylate by the reaction with p-toluenesulfonyl chloride in the presence of a polar solvent using an aqueous solution of sodium hydroxide as a base. The tosylate is made to react with a phenylthiol compound, and then poured into water or water-alcohol mixture.

Also, the compound can be prepared by tosylating a phenylthioalkyl alcohol, and then allowing the tosylate to react with a phenol compound.

(II) Compounds represented by formula (II) can be prepared using various methods. Preferably, these compounds are obtained by utilizing dihaloalkanes or disulfonic acid esters of alkylenediols as a starting material, and (i) reacting them with thiophenols, (ii) reacting them with thiophenols containing an aromatic hydroxyl group, followed by etherification of the aromatic hydroxyl groups remaining unreacted, or (iii) reacting them with alkoxythiophenols. These preparation methods are illustrated in detail below.

Dihaloalkanes and disulfonic acid esters of alkylenediols which each can be employed as a starting material for the preparation of the diaryl thioether compounds, are represented by the following formulae (IV) and (V), respectively.

$$\text{Hal}—R_1—\text{Hal} \quad (IV)$$

$$R_2O_2SO—R_1—OSO_2R_2 \quad (V)$$

Herein, Hal represents a halogen atom, preferably chlorine, bromine, or iodine atom; $R_1$ has the same meaning as R in the foregoing formulae (I), (II), and (III), and represents a divalent group containing from 1 to 10 carbon atoms, particularly preferably a straight or branched chain alkylene, oxaalkylene, thiaalkylene, or alkenylene group. Of these groups, straight chain alkylene, oxaalkylene, polyoxaalkylene, thiaalkylene and like groups containing from 1 to 6 carbon atoms are superior in easiness of preparation and facility to purify the products.

$R_2$ represents an alkyl group or an aryl group, particularly phenyl group or tolyl group.

Specific examples of the compounds of formula (IV) and (V) are described below.

(1) ethylene bromide,
(2) 1,3-propylenebromide,
(3) 1,2-propylenebromide,
(4) ethylene chloride,
(5) 1,4-butylenebromide,
(6) 2,2'-dibromoethyl ether,
(7) 2,2'-dibromoethyl sulfide,
(8) diethylene glycol ditosylate,
(9) 1,3-propanediol ditosylate,
(10) 1,3-butanediol ditosylate,
and so on.

(i) In the method (i) which comprises reacting a dihaloalkane represented by formula (IV) or a disulfonic acid ester of alkylene diol represented by formula (V) with a thiophenol, the compound represented by formula (IV) or (V) is allowed to react with aromatic thiols represented by formula (VI) to yield the intended diaryl thioether compound (VII).

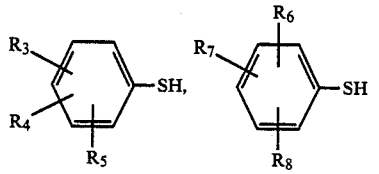

(VI)

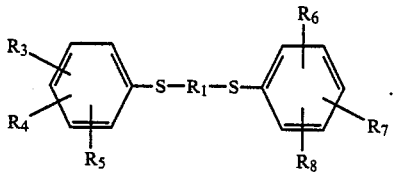

(VII)

In formulae (VI) and (VII), $R_3$, $R_4$, $R_5$, $R_6$, $R_7$, and $R_8$ each represents a hydrogen atom, an alkyl group, an alkoxy group, an aralkyl group, a halogen atom, an alkoxycarbonyl group, or an aryloxycarbonyl group. Also, any two adjacent groups may combine with each other to form a 5- or 6-membered ring. When at least one of the groups $R_3$, $R_4$, and $R_5$ is not a hydrogen atom, the diaryl thioethers produced can bring about better results because of their high melting points. In a special case where such a substituent group is an alkoxy group, a route that the corresponding bisphenol is first prepared and then, its hydroxy group is alkylated may be adopted.

Upon the foregoing reaction, the reaction system may be heated to a temperature ranging from 50° C. to 150° C., and a base selected from among sodium compounds, potassium compounds, calcium compounds, and the like and a solvent, such as water, alcohols, halogenated hydrocarbons, aromatic compounds, polar solvents, etc., may be used together.

Specific examples of the compounds represented by formula (VI) are described below.

(1) thiophenol,
(2) 4-methylphenylthiol,
(3) 3-methylphenylthiol,
(4) 4-ethylphenylthiol,
(5) 4-methoxyphenylthiol,
(6) 4-ethoxyphenylthiol,
(7) 3,5-dimethylphenylthiol,
(8) 1-naphthylthiol,
(9) 2-naphthylthiol, (10) 4-biphenylthiol,
and so on.

(ii) The method (ii) in which a dihaloalkane represented by formula (IV) or a disulfonic acid ester of alkylenediol represented by formula (V) is allowed to react with a thiophenol containing an aromatic hydroxyl group, and the aromatic hydroxyl groups remaining unreacted are etherified is illustrated using the following reaction scheme.

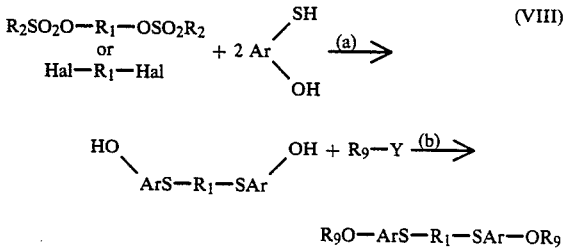

(VIII)

Herein, $R_9$ represents an alkyl group or an aralkyl group. Y represents a halogen atom, a sulfuric acid ester residue, an aromatic sulfonic acid residue, or OH group. Ar has the same meaning as $Ar_1$ or $Ar_2$ in the foregoing formulae (I), (II), and (III).

More specifically, alkyl and aralkyl groups represented by $R_9$ may take a form of straight chain or branched chain. Particularly preferred ones are lower alkyl groups containing not more than 5 carbon atoms and aralkyl groups containing not more than 8 carbon atoms.

As described above, Y represents a halogen atom, a sulfuric acid ester residue, an aromatic sulfonic acid ester residue or OH group. That is, $R_9$-Y represents an etherifying agent, with specific examples including dimethyl sulfate, diethyl sulfate, methyl iodide, ethyl iodide, benzyl chloride, methyl tosylate, ethyl alcohol and so on. However, the etherifying agent which can be used herein is not intended to be construed as being limited to such examples. Of these etherifying agents, sulfuric acid ester compounds and aromatic sulfonic acid ester compounds are particularly desirable in respects of availability and handling facility.

In order to produce the compound represented by formula (VIII) at a low price, by a simple procedure and in a high yield, it is advisable to force the reaction to completion without taking the trouble to take out the intermediate product in the course of production process.

In conducting the reaction (a) and the reaction (b), therefor, the heating up to a temperature ranging from about 50° C. to about 150° C. may be carried out, and the reactants may be used in combination with a base selected from organic bases and inorganic bases such as sodium compounds, potassium compounds, calcium compounds, and so on, and a solvent such as water, alcohols, halogenated hydrocarbons, aromatic compounds, polar solvents, and so on may be present together therewith.

More desirable results can be obtained by using a sodium or potassium compound as the base and a polar solvent as the solvent.

Preferred examples of inorganic bases include sodium hydroxide, potassium hydroxide, sodium carbonate, and potassium carbonate. Of these bases, sodium hydroxide is particularly advantageous in respect of waste liquid disposal.

As for the polar solvents which can be used in the present invention, solvents containing a hydrophilic group such as ether, carbonyl, sulfonyl, cyano, amido, or like group are particularly preferred. Specific examples of such solvents include methyl ethyl ketone, acetonitrile, dimethylacetoamide, acrylonitrile, N-methylpyrrolidone, hexamethylphosphoramide, sulfolane, cyclohexanone, dimethylformamide, dimethyl sulfoxide, acetone, and the like. In particular, water-soluble solvents are desirable from the standpoint of simplifying the after-treatment.

These solvents are used in such an amount that the solids concentration may become 10% or more, preferably 20% or more.

Also, the combined use of such solvents and a small amount of water is desirable from the standpoint of facilitating the dissolution of inorganic bases and sulfonates, and preventing colored by-products from forming. In addition, it is an advantageous means to conduct the reactions in an inert atmosphere, because coloration of the reaction system can be prevented.

Moreover, crown ethers and interphase migratory catalysts may be used in conducting the reaction.

Furthermore, the reaction may be carried out under increased pressure, which can bring about a good result, particularly in the case where acetone is used as the solvent.

A suitable reaction temperature ranges from 20° C. to 150° C., particularly preferably from 50° C. to 100° C., in respects of reactivity, and decomposition of the sulfonic acid esters.

A suitable amount of a base to be used in the present invention is from 2 to 8 moles, preferably from 2 to 6 moles, per mole of dihaloalkane or disulfonic acid ester of diol.

A suitable amount of a thiophenol to be used in the present invention is from 2 to 4 moles, preferably from 2 to 3 moles, per mole of dihalide or disulfonic acid ester of diol.

When halogenides or ester compounds are employed as the etherifying agent to be used in the present invention, the base may be added simultaneously with the etherifying agent. In another manner, the total amount of base required may be added at the beginning of the addition. In particular, it is desirable to add the total amount of base required to the reaction system prior to the addition of the etherifying agent.

When an alcohol is employed as the etherifying agent, it is to be desired that a catalyst, especially an acid catalyst, should be used.

Suitable examples of acid catalysts which can be used include sulfuric acid, hydrochloric acid, an aromatic sulfonic acid, sulfonic acid chloride, trifluoroborate, aluminum chloride, and so on.

Solvents which can be used in the reaction (b) include the same ones as used in the reaction (a).

A suitable amount of etherifying agents to be used in the present invention ranges from 1 to 3 moles, particularly from 1 to 2 moles, per mole of thiophenols.

(iii) The method (iii) in which a dihaloalkane represented by formula (IV) or a disulfonic acid ester of alkylenediol represented by formula (V) is allowed to react with an alkoxythiophenol is illustrated below using a reaction scheme.

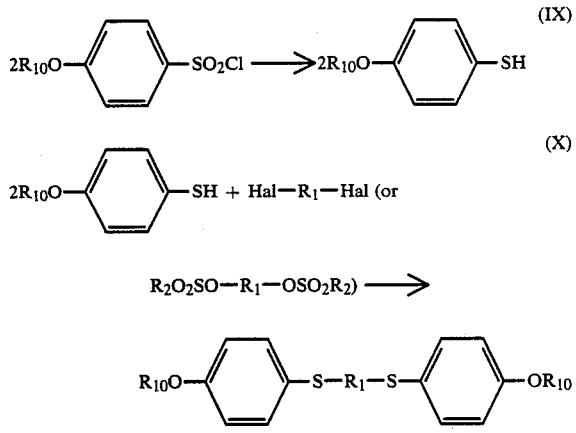

Of alkoxythiophenols, 4-alkoxythiophenols represented by formula (IX) are preferred over others. It is more desirable to prepare the 4-alkoxythiophenols through reduction of 4-alkoxybenzenesulfonyl chloride, because the reaction of this kind can lessen contamination with the ortho compound.

In formulae (IX) and (X), $R_{10}$ represents an alkyl group or an aralkyl group, which each may take either a straight chain or branched form. In particular, a lower alkyl group containing not more than 5 carbon atoms and an aralkyl group containing not more than 8 carbon atoms are preferred as $R_{10}$.

Specific examples of such groups include methyl group, ethyl group, n-propyl group, isopropyl group, n-butyl group, benzyl group, 4-methylbenzyl group, phenoxyethyl group, and the like.

In order to obtain the compound represented by formula (X) at a low price, by a simple procedure and with a low yield of by-products, it is to be desired that the reaction should be forced to completion without taking out the intermediate product in the course of synthesis.

More specifically, 4-alkoxythiophenol produced by reduction of 4-alkoxybenzenesulfonyl chloride is extracted with an aqueous solution of alkali in the presence of a water-insoluble solvent, and then allowed to react with the disulfonic acid ester of alkylenediol or the dihaloalkane.

As examples of reducing agents for 4-alkoxybenzenesulfonyl chloride, mention may be made of metals, metal salts, metal hydrogen complex compounds, hydrazines, and so on. Specifically, zinc, iron, tin, tin chloride, sodium borohydride, hydrazine, and so on can be used. These ingredients undergo more readily the redox reaction under an acidic condition. Therefore, they are preferably used in combination with hydrochloric acid, acetic acid, sulfuric acid, or so on.

In allowing the 4-alkoxythiophenol produced by the reduction reaction to pass into a water-insoluble solvent, the water-insoluble solvent may be added to the reduction reaction system in advance or after the conclusion of the reduction reaction.

Suitable water-insoluble solvents are hydrocarbon series solvents, with specific examples including benzene, toluene, xylene, and the like.

In extracting the 4-alkoxythiophenol from the nonaqueous solution thereof with an aqueous solution of alkali, sodium hydroxide, or potassium hydroxide is preferably used as the alkali and pH of the aqueous solution is within the range of preferably from 7.0 to 10.0, particularly from 7.5 to 9.0. The extraction may be carried out under heating condition, if needed.

The reaction of the 4-alkoxythiophenol in the aqueous solution of alkali with a disulfuric acid ester of alkylenediol or a dihaloalkane may be carried out under temperatures ranging from about 20° C. to about 150° C., and further it may be carried out in the presence of a solvent, such as alcohols, halogenated hydrocarbons, aromatic compounds, polar solvents, or so on. As for the polar solvents which can be added to the aqueous alkali solution of the 4-alkoxythiophenol, solvents containing a hydrophilic group such as ether, carbonyl, sulfonyl cyano, amido, hydroxyl, or like group are particularly preferably employed.

Spcific examples of such solvents include methyl ethyl ketone, acetonitrile, dimethylacetamide, acrylonitrile, N-methylpyrrolidone, hexamethylphosphoramide, sulfolane, cyclohexanone, dimethylformamide, dimethyl sulfoxide, acetone, methanol, ethanol, and the like.

Such a solvent can give a good result when used in a proportion of from 50 to 95%, preferably from 70 to 90%, to the aqueous alkaline solution of the 4-alkoxythiophenol.

It is desirable to carry out the reaction in an inert gas atmosphere in respect that coloration of the reaction solution and conversion of thiophenols to the corresponding disulfides can be prevented from occurring.

Further, crown ethers and interphase migratory catalysts may be used in conducting the reaction.

Furthermore, the reaction may be carried out under increased pressure, which can bring about a good result, particularly in the case where acetone is used as the solvent.

A suitable reaction temperature is within the range of from 20° C. to 150° C., preferably from 40° C. to 100° C., in respect of reactivity, and decomposition of the disulfonic acid ester of alkylenediol, or decomposition of the dihaloalkane.

(III) Compounds represented by formula (III) can be easily prepared by reacting an arylthioalkyl carbonic acid halide with a phenol, wherein catalyst such as triethylamine, pyridine, iodine, zinc chloride, etc. may be used. Compounds represented by formula (III) can also be easily prepared by reacting an arylcarbonyloxyalkyl halide or a sulfonic acid ester of alkyl alcohol with an aromatic thiol.

The compounds represented by formula (I), (II), and (III), respectively, can be prepared using methods as illustrated in the synthesis examples below.

SYNTHESIS EXAMPLE 1

Synthesis of 1-(p-tolythio)-2-(p-ethoxyphenoxy)ethane 34 g of 2-(p-ethoxyphenoxy)ethyltosylate, 12.4 g of 4-methylbenzenethiol, 40 g of potassium carbonate and 50 ml of dimethylacetamide were placed in a 300 ml flask, and stirred for 1 hour as the interior of the flask was maintained at a temperature of from 50° C. to 60° C. The reaction mixture was poured into ice-cold water to deposit crystals. The crystals were recrystallized from methane. Melting point: 89°-91° C.

SYNTHESIS EXAMPLE 2

Synthesis of 1,2-Bis(4-methoxyphenylthio)ethane 30 g of 4-methoxythiophenol, 20.2 g of ethylene bromide, 40 g of potassium carbonate, and 40 ml of dimethylformamide were placed in a 300 ml flask, and stirred for 3 hours as the interior of the flask was maintained at a temperature of from 50° C. to 60° C. The reaction mixture was poured into ice-cold water to deposit crystals. The crystals were recrystallized from methanol-/ethyl acetate 1/1 (volume ratio) mixture. Melting point: 108°-110° C.

SYNTHESIS EXAMPLE 3

Synthesis of 1,2-Bis(4-methylphenylthio)ethane 30 g of thiocresol, 22.6 g of ethylene bromide, 44 g of potassium carbonate and 40 ml of dimethylformamide were placed in a 300 ml flask, and stirred for 5 hours over a water bath. The reaction mixture was poured into ice-cold water to deposit crystals. The crystals were recrystallized from a methanol/ethyl acetate mixed solvent. Melting point: 79°-80° C.

SYNTHESIS EXAMPLE 4

Synthesis of Phenylthioacetic p-Biphenyl Ester 16.8 g of phenylthioacetic acid was allowed to react with 14 ml of sulfonyl chloride in toluene for 1 hour at room temperature. Excess sulfonyl chloride was distilled away under reduced pressure over a water bath warmed up to about from 60° C. to 80° C. The residue was allowed to react with p-phenylphenol in the presence of a base like triethylamine, and the reaction mixture was poured into water to yield crystals with ease. Melting point: 89°-90° C.

SYNTHESIS EXAMPLE 5

Synthesis of 1,2-Bis(4-methoxyphenylthio)ethane

In a flask equipped with a stirrer were placed 40 ml of sulfolane, 0.1 mole of 1,2-di-chloroethane and 0.22 mole of monothiohydroquinone. Thereto, a 48 wt% water solution of sodium hydroxide was added dropwise while stirring in a total amount of 0.5 mole equivalent with caution so as not to raise the temperature of the interior to 45° C. or higher. Then, the reaction mixture was refluxed at 50° C. for 2 hours. To the resulting mixture, 0.22 mole of dimethyl sulfate was added dropwise, and then refluxed with stirring for an additional 30 minutes. The thus obtained reaction mixture was poured into ice-cold water to precipitate the product in a crystallized condition. The crystalline product was filetered off, and recrystallized from a methanol/ethyl acetate mixture. Melting point: 108°-110° C.

SYNTHESIS EXAMPLE 4

Synthesis of 1,2-Bis(4-ethoxyphenylthio)ethane 1,2-Bis(4-ethoxyphenylthio)ethane was prepared in the same manner as employed in Synthesis Example 5 except that 1,2-di-p-tolylsulfonyloxyethane and diethyl sulfate were used in place of 1,2-di-chloroethane and dimethyl sulfate, respectively. Melting point: 90° C.

SYNTHESIS EXAMPLE 7

Synthesis of 1,2-Bis(4-methoxyphenylthio)ethane 240 g of 40% sulfuric acid was poured on rubble ice and cooled to 0° C. or below. Thereto, 62 g of 4-methoxybenzenesulfonyl chloride was added dropwise while stirring thoroughly and further, 100 g of zinc powder was added in limited amounts with caution so as not to raise the temperature of the interior to 30° C. or higher. At the conclusion of the addition the reaction system was heated, if necessary, to force the reduction reaction to completion. After the conclusion of the reaction the 4-methoxythiophenol produced was extracted with 200 ml of toluene and further, extracted from the toluene extract with 85 ml of 15% aqueous solution of sodium hydroxide. The resulting alkaline extract of the 4-methoxythiophenol was ixed with 250 ml of methanol with vigorous stirring and thereto, 14.9 g of 1,2-dichloroethane was added in limited amounts with caution so as not to raise the temperature of the interior to 60° C. or higher. The stirring was continued at 40° C. for additional 4 hours. Then, the reaction mixture was poured into ice-cold water to deposit crystals. These crystals were filtered off, washed with water and methanol, and recrystallized from a methanol/ethyl acetate mixture. Melting point: 108°-110° C.

SYNTHESIS EXAMPLE 8

Synthesis of 1,4-Bis(4-methoxyphenylthio)butane 1,4-Bis(4-methoxyphenylthio)butane was prepared in the same manner as employed in Synthesis Example 7 except that 1,4-di-p-tolyloxybutane was used in place of 1,2-dichloroethane. Melting point: 102°-103° C.

SYNTHESIS OF EXAMPLE 9

Synthesis of 1,2-Bis(4-ethoxyphenylthio)ethane 1,2-Bis(4-ethoxyphenylthio)ethane was prepared in the same manner as employed in Synthesis Example 7 except that 4-ethoxybenzenesulfonyl chloride was used in place of 4-methoxybenzenesulfonyl chloride. Melting point: 90°-91° C.

SYNTHESIS EXAMPLE 10

Synthesis of 1,2-Bis(4-n-propoxyphenylthio)ethane 1,2-Bis(4-n-propoxyphenylthio)ethane was prepared in the same manner as employed in Synthesis Example 4 except that 4-n-propoxybenzenesulfonyl chloride was used in place of 4-methoxybenzenesulfonyl chloride. Melting point: 111°-112° C.

SYNTHESIS EXAMPLE B 11

Synthesis of 1,2-Bis(4-isopropoxyphenylthio)ethane 1,2-Bis(4-isopropoxyphenylthio)ethane was prepared in the same manner as employed in Synthesis Example 7 except that 4-isopropoxybenzenesulfonyl chloride and 1,2-dibromoethane were used in place of 4-methoxybenzenesulfonyl chloride and 1,2-dichloroethane, respectively. Melting point: 115°-116° C.

SYNTHESIS EXAMPLE 12

Synthesis of 1,2-Bis(4-n-butoxyphenylthio)ethane 1,2-Bis(4-n-butoxyphenylthio)ethane was prepared in the same manner as employed in Synthesis Example 7 except that 4-n-butoxybenzenesulfonyl chloride was used in place of 4-methoxybenzenesulfonyl chloride. Melting point: 102°-103° C.

As for the electron donating colorless dyes, triarylmethane compounds, diphenylmethane compounds, xanthene compounds, thiazine compounds, spiropyran compounds, and so on can be employed in the present invention. Specific examples of triarylmethane compounds include 3,3-bis(p-dimethylaminophenyl)-6-dimethylaminophthalide, 3,3-bis(p-dimethylaminophenyl)phthalide, 3-(p-dimethylaminophenyl)-3-(1,3-dimethylindole-3-yl)phthalide, 3-(p-dimethylaminophenyl)-3-(2-methylindole-3-yl)phthalide, and the like. Specific examples of diphenylmethane compounds include 4,4'-bis-dimethylaminobenzhydrin benzyl ether, N-halophenyl leuco Auramine, N-2,4,5-trichlorophenyl leuco Auramine, and the like. Specific examples of xanthene compounds include Rhodamine B anilinolactam, Rhodamine (p-nitroanilino)lactam, Rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilno-3-ethoxy-6-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluoran, and the like. Specific examples of thiazine compounds include benzoyl leuco Methylene Blue, p-nitrobenzyl leuco Methylene Blue, and the like. Specific examples of spiro compounds include 3-methyl-spiro-dinaphthopyran, 3-ethyl-spiro-dinaphthopyran, 3,3'-dichlorospiro-dinaphthopyran, 3-benzyl-spiro-dinaphthopyran, 3-methyl-naphtho-(3-methoxybenzo)spiropyran, 3-propyl-spiro-dibenzopyran, and so on. These dyes can be used alone or as a mixture. In particular, a combined use of two kinds of dyes which can show black hue is preferred.

As for the electron accepting compounds, phenol compounds, organic acids or metal salts thereof, oxybenzoates inorganic acids, and so on can be used in the present invention. Of these compounds, phenols are more advantageous, because the addition in a small amount suffices for color development. Specific examples of electron accepting compounds which can be used preferably include 2-(4-hydroxyphenyl)-2-(3-isopropyl-4-hydroxyphenyl)propane, 2-(4-hydroxyphenyl)-2-(3-allyl-4-hydroxyphenyl)propane, 2-(4-hydroxyphenyl)-2-(3-methyl-4-hydroxyphenyl)propane, α-isopropyl-β-naphthol, methyl-4-hydroxybenzoate, monomethylated dihydroxybiphenyl, 2,2-bis(4-hydroxyphenyl)propane (bisphenol A), 4,4'-isopropylidenebis(2-methylphenol), 1,1-bis(3-chloro-4-hydroxyphenyl)cyclohexane, 1,1-bis(3-chloro-4-hydroxyphenyl)-2-ethylbutane, 4,4'-isobutylidenediphenol, 4-hydroxybenzoic benzyl ester, 4-hydroxybenzoic m-chlorobenzyl ester, 4-hydroxybenzoic-phenetyl ester, 4-hydroxy-2'4'-dimethyldiphenylsulfone, 1-t-butyl-4-p-hydroxyphenylsulfonyloxybenzene, 4-N-benzylsulfamoylphenol, 2,4-dihydroxybenzoic p-methylbenzyl ester, 2,4-dihydroxybenzoic β-phenoxyethyl ester, 2,4-dihydroxy-6-methylbenzoic benzyl ester, zinc chloride, zinc rhodanide, and so on.

The ether compound or the thioether compound in accordance with the present invention is used in a form of dispersion containing, in a dispersion medium, particles divided finely using a grinding or dispersing apparatus till it comes have a size (volume average size) of 5 microns or less. In another manner, the compound of the present invention is added to a dispersion medium simultaneously with an electron donating colorless dye and/or an electron accepting compound, and they are all subjected to a dispersing treatment using a ball mill, a sand mill, or the like.

In particular, simultaneous dispersion of a colorless dye with the compound of the present invention can afford an advantage that the dispersion obtained is hardly uncolored.

In addition, simultaneous dispersion of the compound of the present invention with an electron accepting compound has an advantage in that an increase in sensitivity is likely to be achieved.

In using an electron donating colorless dye and an electron accepting compound in the present invention, they are ground and dispersed in a dispersion medium till they come to have an average particle size of 3 microns or less, preferably 2 microns or less. As the dispersion medium, a 0.2 to 5% aqueous solution of water-soluble high molecular weight polymer is employed. The dispersion is carried out using a ball mill, a sand mill, an attritor, a colloid mill, etc.

The electron donating colorless dye is used in an amount of from 0.1 to 0.8 g/m$^2$, preferably from 0.2 to 0.5 g/m$^2$ in the recording layer.

A preferred ratio of an electron donating colorelss dye to an electron accepting compound in the present invention ranges from 1/10 to 1/1 by weight, and particularly preferably is from 1/5 to 2/3 by weight.

The compound characteristic of the present invention is preferably added in a proportion of from 20 wt% to 300 wt%, and particularly preferably from 40 wt% to 150 wt%, with respect to the amount of electron accepting compound used.

When added in a proportion less than 20 wt%, it tends not to confer a sufficient sensitivity-increasing effect at which the present invention aims, whereas it rather tends to cause a decrease in sensitivity when added in a porportion more than 300 wt%.

To a dispersion thus prepared, additives are further added for coating for fulfilling varius requirements.

As an example of additives, oil-absorbing substances, such as inorganic pigments and so on, can be cited, and they are dispersed in a coating composition in advance for the purpose of preventing a recording head from being stained upon recording. Further, fatty acids, metal soaps, and the like are added to the coating composition for the purpose of enhancing the ability to release from a recording head. Accordingly, pigments, waxes, antistatic agents, surface active agents and other agents in addition to color former and color developer which contribute directly to coloration are generally coated on a support in order to constitute a heat-sensitive recording material.

Specific examples of pigments which can be used herein include kaolin, calcined kaolin, talc, agalmatolite, diatomaceous earth, calcium carbonate, aluminum hydroxide, magnesium hydroxide, magnesium carbonate, titanium oxide, barium carbonate, barium sulfate, calcined gypsum, urea-formaldehyde filler, gypsum, cellulose filler, and so on. Specific examples of waxes which can be used herein include paraffin wax, carnauba wax, microcrystalline wax, polyethylene wax, and higher fatty acid esters. Specific examples of metal soaps which can be used herein include metal salts of fatty acids such as zinc stearate, aluminum stearate, calcium stearate, zinc oleate, etc.

These additives are dispersed into a binder, and then coated. Water-soluble binders are generally used for dispersing the additives, with specific examples including polyvinyl alcohol, hydroxyethyl cellulose, hydroxypropyl cellulose, ammonium salts of ethylene-maleic anhydride copolymers, styrene-maleic anhydride copolymers, isobutylene-maleic anhydride copolymers, polyacrylic acid, acrylamide copolymers, denatured polyacrylic acid amides, starch derivatives, casein, gelatin, and so on. Further, an agent for imparting a water resisting property to these binders (e.g., a gelling agent or a crosslinking agent, etc.) can be added, or an emulsion of hydrophobic polymer such as styrene-butadiene rubber latex, an acryl resin emulsion or the like can also be used.

Furthermore, a protective layer made up of polyvinyl alcohol, methylol-acrylamide copolymer or the like, and methylolmelamine, boric acid, or the like can be provided.

The thus prepared coating composition is most generally coated on a smooth support having a thickness of from 5 microns to 250 microns, preferably neutralized paper, and subjected to calender finish.

For coating, an air knife coating technique, a blade coating technique, a curtain coating technique, etc., can be employed.

In general, the coverage of the coating composition is from 2 to 100 g/m$^2$ on a solids basis. The lower limit of the coverage is determined by color density attainable by heat development, while the upper limit is determined mainly by economic considerations.

The present invention is illustrated in detail by reference to the following example. However, the invention is not intended to be construed as being limited to this example.

EXAMPLE (1) Preparation of Sample:

An electron donating colorless dye mixture constituted with 2.0 g of 2-anilino-3-chloro-6-diethylaminofluoran and 3.5 g of 2-anilino-3-methyl-6-N-methyl-N-isoamylaminofluoran, and 10 g of one of the ether compounds set forth in Table were dispersed into 35 g of a 5% aqueous solution of polyvinyl alcohol (saponification degree: 99%, polymerization degree: 1,000) using a sand mill. Separately, 10 g of bisphenol A as an electron accepting compound received a dispersing treatment together with 100 g of a 5% aqueous solution of polyvinyl alcohol using a sand mill.

After mixing these dispersions, 20 g of kaolin (Georgia kaolin) was added and dispersed thoroughly. Thereto, 3.5 g of a 50% dispersion of paraffin wax emulsion (Cellosol #428, products of Chukyo Yushi Co., Ltd.) was further added to prepare a composition for coating.

The composition was coated on neutralized paper having a basis weight of 50 g/m$^2$ at a coverage of 5.8 g/m$^2$ based on a solids basis. After drying at 60° C. for 1 minute, the coated layer was smoothened using a super-calendering processing under linear pressure of 68 kgW/cm. Thus, a recording material was obtained.

The recording material was made to develop a color by applying thermal energy of 30 mJ/mm$^2$ thereto using a facsimile apparatus UF-2 (made by Matsushita Denso Co., Ltd.). Density of the developed color was measured using a densitometer RD-514 (made by Macbeth Co., Ltd.). The color developed coating papers obtained in Examples 1 to 10 were allowed to stand at 40° C. and 90% RH for 24 hours and then density of the developed color was measured.

Data obtained are shown in Table.

(2) Preparation of Sample for Comparison:

A sample was prepared in the same manner as the above-described samples except that stearic acid amide was used in place of the ether derivatives of the present invention. This sample also was tested in a similar manner as above, and the result obtained is also set forth in Table.

As can be clearly seen from the data in Table, the recording materials prepared in accordance with the present invention had much higher sensitivities than the comparison examples, as evidenced by the higher density obtained.

TABLE

| Sample | Ether Compound | Color Density Before Preservation | Color Density After Preservation |
|---|---|---|---|
| 1 | 1-(p-tolylthio)-2-(p-ethoxyphenoxy)ethane (m. pt. 89–91° C.) | 1.02 | 1.01 |
| 2 | 1-(p-tolylthio)-2-(naphthyl-2-oxy)ethane (m. pt. 95–96° C.) | 0.99 | 0.99 |
| 3 | 1-(p-methoxybenzenethio)-2-(p-ethoxyphenoxy)ethane (m. pt. 87–88° C.) | 1.00 | 0.99 |
| 4 | 1-(p-tolylthio)-2-(p-biphenyloxy)-ethane (m. pt. 119–121° C.) | 1.01 | 1.00 |
| 5 | 1,2-bis(4-methoxyphenylthio)ethane | 1.00 | 1.00 |
| 6 | 1,2-bis(4-methylphenylthio)ethane | 0.98 | 0.97 |
| 7 | bis [2-(4-methoxyphenylthio)ethyl]-sulfide | 0.97 | 0.96 |
| 8 | phenylthioacetic p-bisphenyl ester | 0.99 | 0.98 |
| 9 | p-tolylthioacetic p-chlorophenyl ester | 0.98 | 0.98 |
| 10 | m-tolylthioacetic p-biphenyl ester | 0.98 | 0.97 |
| Comparison | — | 0.62 | 0.48 |

While the invention has been described in detail and with reference to specific embodiments thereof, it will be apparent to one skilled in the art that various changes and modifications can be made therein without departing from the spirit and scope thereof.

What is claimed is:

1. A recording material comprising an electron donating colorless dye, an electron accepting compound, and at least one compound represented by formula (I), (II), or (III)

$$Ar_1O—R—SAr_2 \quad (I)$$

$$Ar_1S—R—SAr_2 \quad (II)$$

$$Ar_1S—R—X—Ar_2 \quad (III)$$

wherein $Ar_1$ and $Ar_2$ each represents a substituted or unsubstituted aryl group, but not a phenolic group, R is a divalent group containing from 1 to 10 carbon atoms, and X represents a —COO— group or an $$—\overset{O}{\overset{\|}{O}}—C—$$

group.

2. A recording material as in claim 1, wherein compound represented by formula (I), (II), and (III) is present in a proportion of from 20 wt% to 300 wt% with respect to the amount of electron accepting compound.

3. A recording material as in claim 2, wherein $Ar_1$ and $Ar_2$ each represents a group selected from a phenyl group and a naphthyl group.

4. A recording material as in claim 3, wherein said phenyl group or naphthyl group is substituted by a substituent containing from 0 to 4 carbon atoms.

5. A recording material as in claim 1, wherein compound represented by formula (I), (II), and (III) is present in a proportion of from 40 wt% to 150 wt% with respect to the amount of electron accepting compound.

6. A recording material as in claim 5, wherein $Ar_1$ and $Ar_2$ each represents a group selected from a phenyl group and a naphthyl group.

7. A recording material as in claim 6, wherein said phenyl group or naphthyl group is substituted by a substituent containing from 0 to 4 carbon atoms.

8. A recording material as in claim 1, wherein $Ar_1$ and $Ar_2$ each represents a group selected from a phenyl group and a naphthyl group.

9. A recording material as in claim 4, wherein said phenyl group or napthyl group is substituted by a substituent containing from 0 to 4 carbon atoms.

10. A recording material as in claim 1, wherein the substituents for $Ar_1$ and $Ar_2$ are selected from the group consisting of a cyano group, an alkylthio group, an acyl group, an alkyl group, an aryloxy group, an alkoxy group, an acylamino group, a halogen atom, an alkoxycarbonyl group, an aralkyl group, an aralkyloxycarbonyl group, an alkenyl group, an alkenyloxy group, an alkynyl group, a cycloalkenyl group, an oxy group, an alkanesulfonyl group, a carbonato group, a sulfo group, a sulfonato group and an aryl group.

11. A recording material as in claim 10, wherein either $Ar_1$ or $Ar_2$ are substituted.

12. A recording material as in claim 1, wherein the substituents for $Ar_1$ and $Ar_2$ are selected from the group consisting of a methyl group, an ethyl group, an isopropyl group, a methoxy group, an ethoxy group, an allyl group, a chlorine atom, a fluorine atom, an acetyl group, a propionyl group, a butoxy group, an oxy group, a methylthio group, a methoxycarbonyl group, and a chloromethyl group.

13. A recording material as in claim 12, wherein either $Ar_1$ or $Ar_2$ are substituted.

14. A recording material as in claim 1, wherein the electron donating colorless dye, electron accepting compound, and at least one compound represented by formula (I), (II) or (III) are provided in the same layer.

15. A recording material comprising an electron donating colorless dye, an electron accepting compound, and at least one compound represented by formula (I) or (III)

$$Ar_1O—R—SAr_2 \quad (I)$$

$$Ar_1S—R—X—Ar_2 \quad (III)$$

wherein $Ar_1$ and $Ar_2$ each represents a substituted or unsubstituted aryl group or a substituted or unsubstituted heterocyclic ring, R is a divalent group containing from 1 to 10 carbon atoms, and X represents —COO— group or $$—\overset{O}{\overset{\|}{O}}—C—$$

group.

* * * * *